US006070500A

United States Patent [19]

Dlask et al.

[11] Patent Number: 6,070,500

[45] Date of Patent: Jun. 6, 2000

[54] ROTATABLE DIE HOLDER

[75] Inventors: Jiri Dlask, Canmore; Darrall Rigby, Calgary, both of Canada

[73] Assignee: White Bear Energy Serives Ltd., Calgary, Canada

[21] Appl. No.: 09/062,611

[22] Filed: Apr. 20, 1998

[51] Int. Cl.[7] ..... B25B 13/50

[52] U.S. Cl. ..... 81/57.33; 81/57.18

[58] Field of Search ..... 81/57.33, 57.15–57.21, 81/57.34, 421–424, 90.2, 90.3, 90.5, 90.7

[56] References Cited

U.S. PATENT DOCUMENTS

| | | | |
|---|---|---|---|
| 1,750,817 | 3/1930 | Root | 81/423 X |
| 2,150,611 | 3/1939 | Speck | 81/57.15 |
| 4,060,014 | 11/1977 | Turner, Jr. | 81/57.2 |
| 4,437,363 | 3/1984 | Haynes | 81/57.18 |
| 5,022,291 | 6/1991 | McBain | 81/424 |
| 5,159,860 | 11/1992 | Pietras | 81/57.19 |
| 5,161,439 | 11/1992 | Wesch, Jr. | 81/57.15 |
| 5,167,173 | 12/1992 | Pietras | 81/57.15 |
| 5,172,613 | 12/1992 | Wesch, Jr. | 81/57.33 |
| 5,778,742 | 7/1998 | Stuart | 81/57.33 X |

*Primary Examiner*—D. S. Meislin
*Attorney, Agent, or Firm*—Thomas E. Malyszko

[57] ABSTRACT

A jaw assembly is provided for a power tong or back-up tong to make up and break out a pipe section. The jaw assembly includes a jaw element for transferring torque from the tong to the pipe section, and a means for moving the jaw element into and out of gripping engagement with the pipe section. At least one die holder is rotatably mounted to the jaw element and is adapted to freely twist about a first axis oriented generally parallel to a longitudinal axis of the pipe section when engaged with said jaw element. The rotation of the die holder about the first axis allows the die holder to align itself with the pipe section upon engagement therewith and to provide an independent camming action against the pipe section to at least radially maintain the die holder's grip on the pipe section and avoid slippage therebetween when transferring torque. The jaw assembly may therefore be used on a range of pipe sizes without having to change the jaw.

15 Claims, 6 Drawing Sheets

ROTATABLE DIE HOLDER

FIELD OF THE INVENTION

The present invention relates to hydraulic power tongs and back-up tongs used for making up and braking out conventional drill pipe connections in the oil and gas industry, and in particular to an improved die holder for use with such tongs.

BACKGROUND OF THE INVENTION

Tubular members such as drill pipe, tubing pipe and casing used in the oil and gas industry (herein referred to as "pipe sections") are joined at their ends by threaded connections. Power tongs and back-up tongs are used to make up (i.e. join) and break out (i.e. disconnect) these threaded connections. The back-up tong grips the lower stationary pipe section while the power tong grips the adjoining upper pipe section and rotates it to provide a fluid-tight seal during make up of the drill string, and to break out the threaded connection during disassembly of the drill string.

Several dies or die inserts engage the outer cylindrical or peripheral surface of each pipe section during the gripping action. FIG. 1 shows one conventional design of a jaw frame 10 which carries two flat dies 11 with teeth for biting the pipe section's peripheral surface. The jaw frame 10 has a cam follower or jaw roller 12 which travels along a cam surface of a power tong's rotary gear in a known manner for camming the dies 11 against the pipe section. Typically two or more jaw frames are required to properly grip a pipe section. The flat die shown is popular because it is relatively inexpensive and may be replaced when worn out.

It is desireable that the jaws' pipe engaging portions (for example, the die inserts) spaced about a pipe section provide an even or uniform bite on the pipe section during use. The center of each pipe engaging portion should be generally tangential to the pipe section during initial contact and even upon applying torque to the pipe section so that a maximum number of jaw teeth squarely engage the pipe section's peripheral outer surface. In FIG. 1 the die inserts 11 are fixed in the jaw 10 to properly bite a 5.5 inch outer diameter ("OD") pipe, indicated by reference numeral 14. A disadvantage of the prior art jaw design is that such desired contact is lost for different sized pipe sections, such as the 4.75 inch OD pipe section indicated by 15. Hence, another tong is needed or the entire jaw assembly should be replaced to provide the die inserts with the desired orientation to the new pipe section 15. Such replacement is expensive and time consuming, and therefore not practical for typical rig operators. If the existing jaw is used without being replaced, then the die teeth may unduly damage the pipe section's peripheral surface, requiring early replacement or repair of the pipe section to avoid buckling or failure during use.

A related problem with prior art jaw frame designs is that they do not adequately address uneven wear of the tool joints of the drill string. Even if a jaw assembly provides an even bite upon initial contact with one pipe section, it will not necessarily bite properly on another pipe section of a drill string because the OD on each pipe section is not necessarily uniform due to wear, thus reducing die-to-pipe contact. Upon the application of torque the die teeth which remain in contact with the pipe section tend to dig deeper into the pipe wall to transmit a required amount of torque for make up or break out, thereby further accelerating wear on the pipe sections.

Yet another problem with conventional jaw assemblies, particularly in back-up tongs, is that the hydraulic cylinder which pushes the jaw assembly into contact with a pipe section tends to relax somewhat during use when a small volume of hydraulic fluid leaks out of the cylinder, resulting in a small but unwanted release of clamping force by the dies on the pipe section. The pipe section may therefore slip during make up or break out operations and damage the tool joint's peripheral wall, or the operator must manually apply more hydraulic pressure than is otherwise necessary to compensate for such relaxation.

Prior references such as U.S. Pat. No. 5,172,613 (Wesch, Jr.), U.S. Pat. No. 5,167,173 (Pietras) and U.S. Pat. No. 4,437,363 (Haynes) attempt to address some of the above problems, but the proposed solutions are flawed, and none of the references are able to overcome all of the above problems.

What is therefore desired is a novel jaw assembly which overcomes the limitations and disadvantages of existing assemblies. Preferably, the jaw assembly should have individual die holders each of which is independently capable of squarely aligning a pipe engaging face or die insert with any one of a variety of pipe section sizes, and in particular the pipe gripping face should align itself substantially tangentially with the peripheral surface of a given pipe section upon engaging it. The die holder of the jaw assembly of the present invention should also provide an independent or secondary camming action to enhance its grip on the pipe section during make up and break out operations, and provide an even or substantially uniform bite about the pipe section. The die holder should be capable of holding and using conventional and relatively inexpensive flat die inserts.

SUMMARY OF THE PRESENT INVENTION

In one aspect the invention provides a jaw assembly for a tong to make up and break out a pipe section comprising: a jaw element for transferring torque from said tong to said pipe section; means for moving said jaw element into and out of gripping engagement with said pipe section; and, at least one die holder rotatably mounted to said jaw element and adapted to twist about a first axis oriented generally parallel to a longitudinal axis of said pipe section when engaged with said jaw element, said rotation of said at least one die holder about said first axis allowing the at least one die holder to align itself with the pipe section upon engagement therewith and providing an independent camming action against said pipe section to at least radially maintain the grip of said at least one die holder on said pipe section during said transfer of torque.

In another aspect the invention provides a jaw element of a hydraulically operated tong for imparting a first gripping action on a pipe section and transferring a torque thereto during make-up and break out operations wherein the improvement comprises a plurality of die holders carried by said jaw element, each die holder having a single, generally planar pipe engaging surface and each die holder being rotatably mounted to said jaw element for twisting about a first axis to align said pipe engaging surface generally tangentially with said pipe section upon engagement therewith and to provide a second camming action against said pipe section independent of said first gripping action for maintaining hold of said pipe section and avoiding slippage therebetween during said operations.

In yet another aspect the invention provides a hydraulically operated tong for use in making up and breaking out a threaded connection of axially extending pipe sections comprising: a tong body for receiving said threaded connection therein; at least one jaw carried by said tong body; said tong body having a first gripping arrangement for radially moving said at least one jaw into gripping engagement with said threaded connection to transfer a torque thereto during said making up and breaking out; and, a plurality of die holders carried by said at least one jaw, each die holder having a single, generally planar pipe engaging surface and each die holder being rotatably mounted to said at least one jaw for twisting about a first axis to align said pipe engaging surface generally tangentially with said treaded connection upon engagement therewith and to provide a second radial gripping action against said threaded connection independent of said first gripping arrangement for maintaining grip on said threaded connection during said making up and breaking out.

BRIEF DESCRIPTION OF THE DRAWING FIGURES

Embodiments of the invention will now be described, by way of example only, with reference to the accompanying drawings, wherein.

Figure 7C:
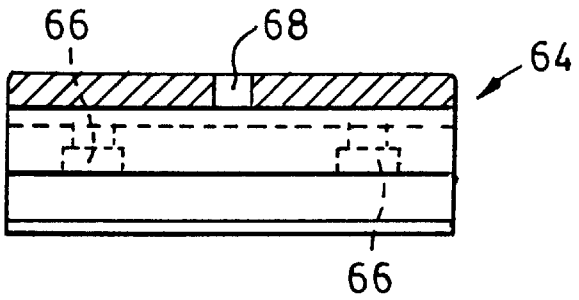
Figure 7A:
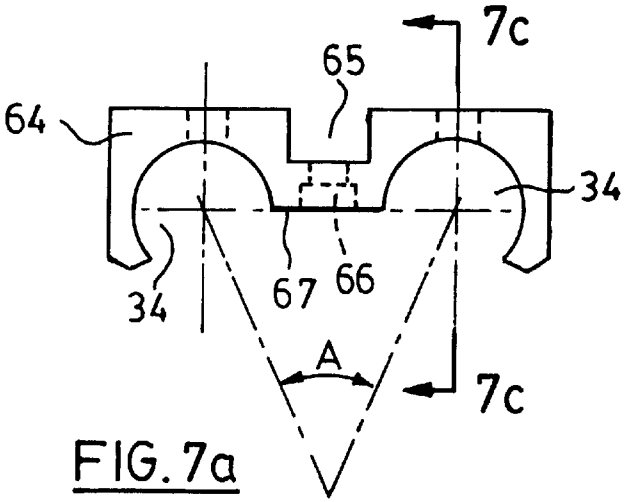
Figure 7B:
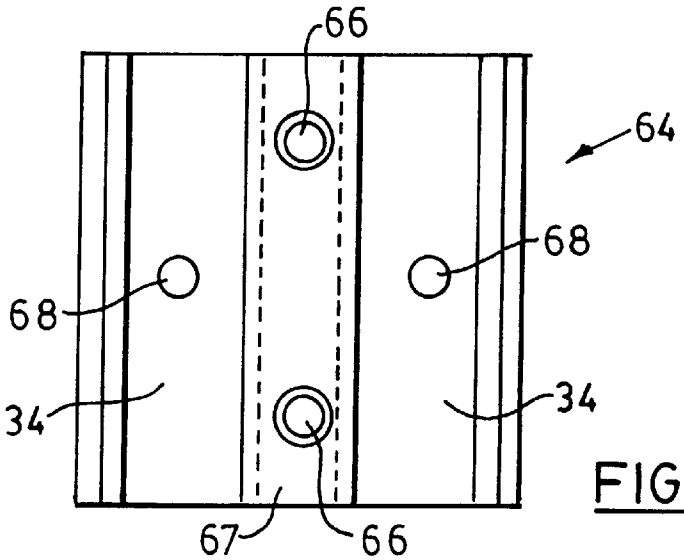

FIG. 7*a* is an isolated plan view of a jaw insert of the second embodiment of the jaw assembly;

FIG. 7*b* is an elevated frontal view of the jaw insert of FIG. 7*a;*

FIG. 7*c* is a sectional view along line 7*c*—7*c* of FIG. 7*a;*

Figure 8C:
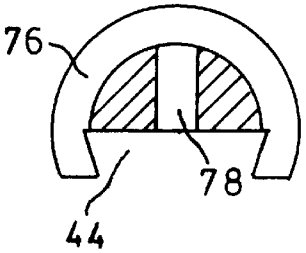
Figure 8B:
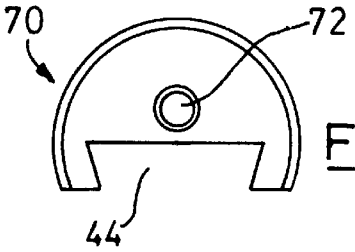
Figure 8A:
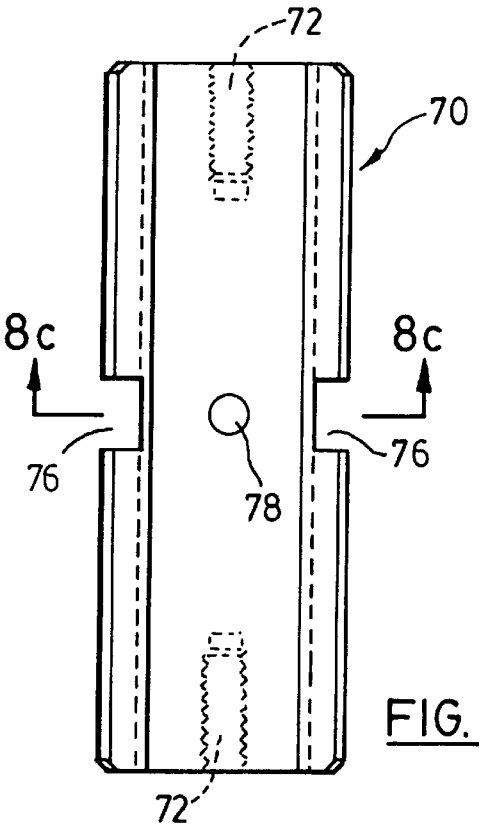

FIG. 8*a* is an elevated frontal view of a die holder of the second embodiment of the jaw assembly;

FIG. 8*b* is a plan view of the die holder of FIG. 8*a;*

FIG. 8*c* is a sectional view along line 8*c*—8*c* of FIG. 8*a;*

Figure 9C:
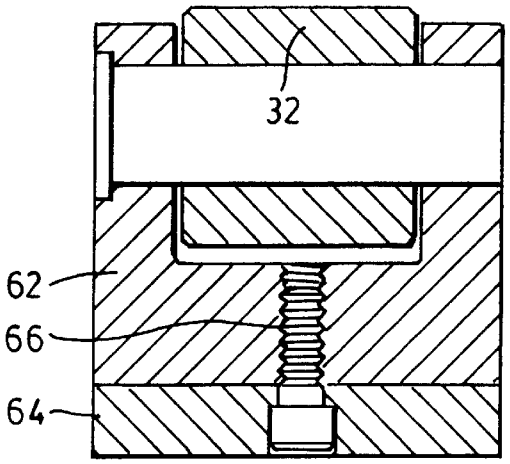
Figure 9B:
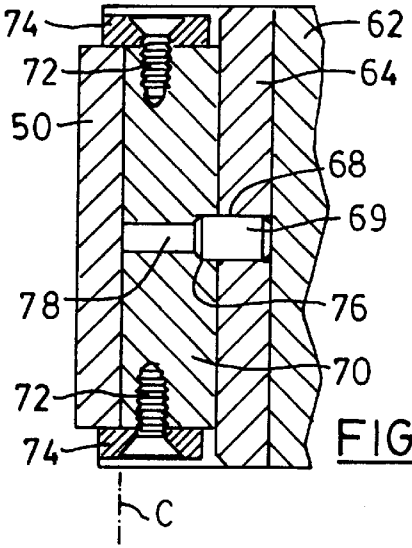
Figure 9A:
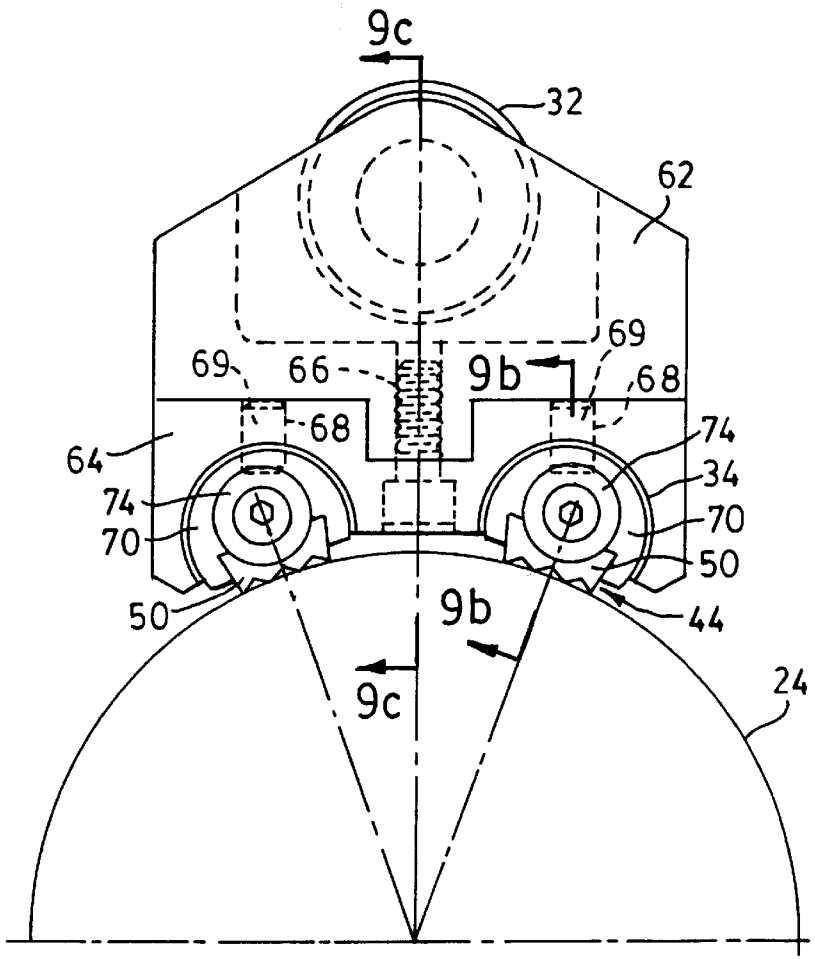

FIG. 9*a* is a more detailed plan view of the second embodiment of the jaw assembly engaging a pipe section;

FIG. 9*b* is a sectional view along line 9*b*—9*b* of FIG. 9*a;* and, FIG. 9*c* is a sectional view along line 9*c*—9*c* of FIG. 9*a*.

DESCRIPTION OF PREFERRED EMBODIMENTS

Figure 5:
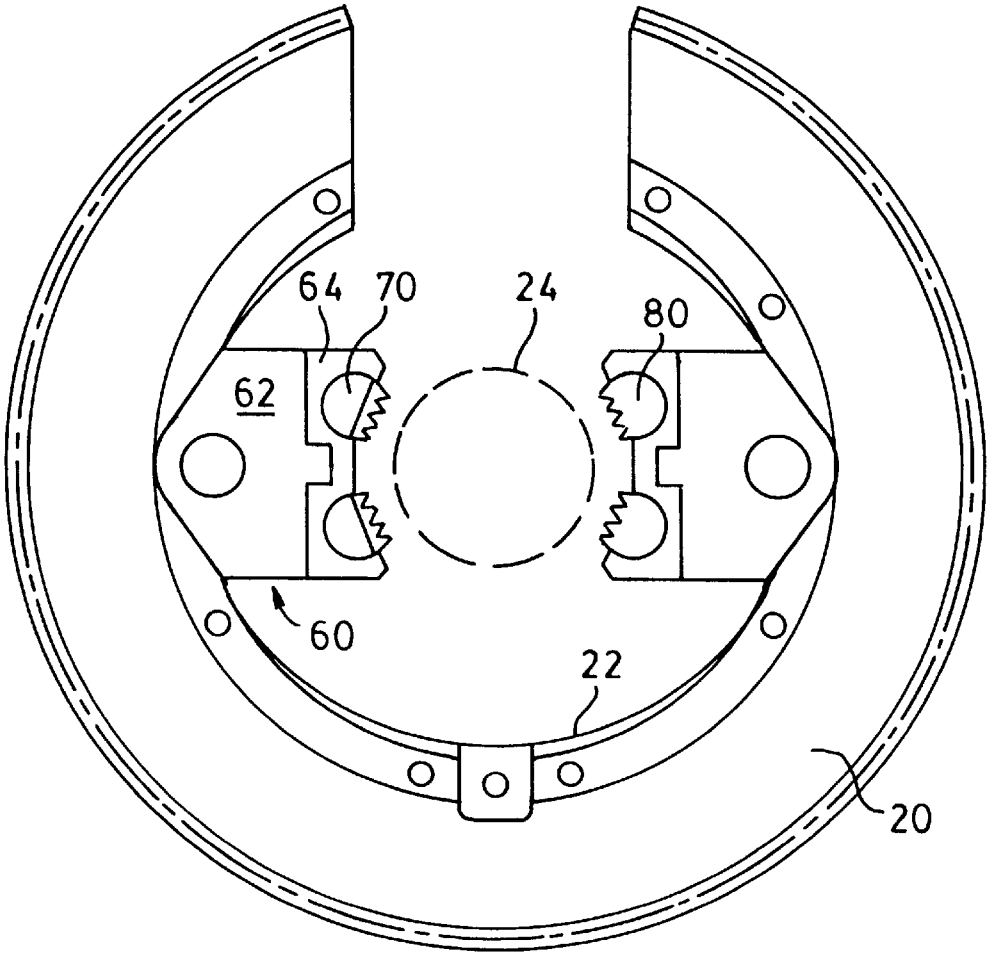
FIG. 5 is a plan view of a rotary gear of a power tong carrying on the left and right sides thereof jaw assemblies according to second and third embodiments of the present invention, respectively.
Figure 6:
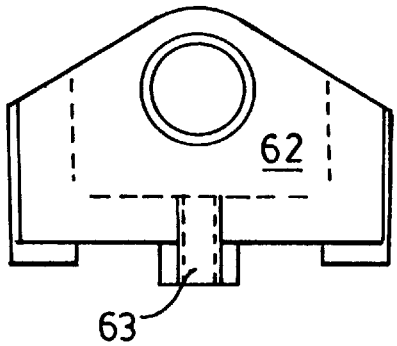
FIG. 6 is an isolated plan view of a master jaw of the second embodiment of the jaw assembly.

The die holder jaw assembly of the present invention, in its various embodiments, may be used in power tongs and in back-up tongs, and in both active and passive jaw assemblies. A jaw assembly typically employed in a power tong is chosen herein for illustrative purposes. Referring to FIG. 5, such a jaw assembly typically travels along a cam surface 22 of a power tong's rotary gear 20 in a known manner to exert incrementally a primary or first camming action against a pipe section 24 located therein to grip the pipe section and transfer torque from the tong to the pipe section. For ease of reference, the "primary camming" action in a back-up tong is provided by the hydraulic cylinder system which engages the jaw assemblies with the pipe section.

Figure 1:
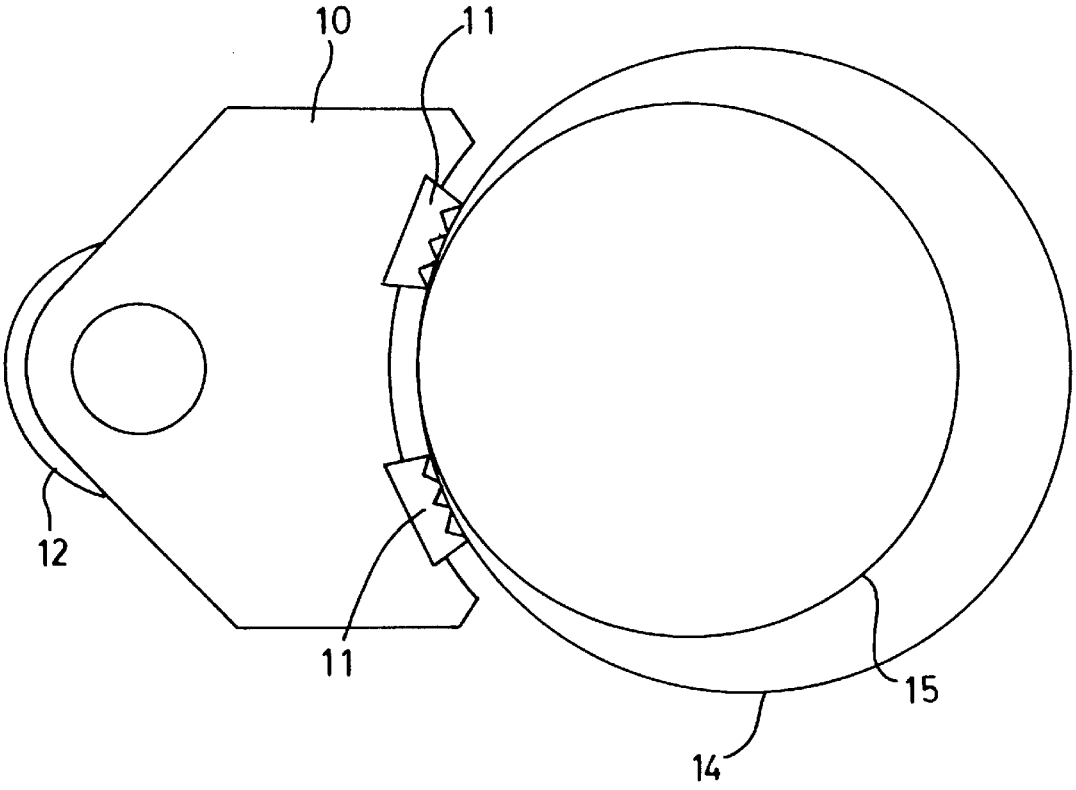
FIG. 1 is a plan view of a prior art jaw frame which holds conventional flat die inserts for use in a power tong to make up and break out pipe sections.
Figure 2:
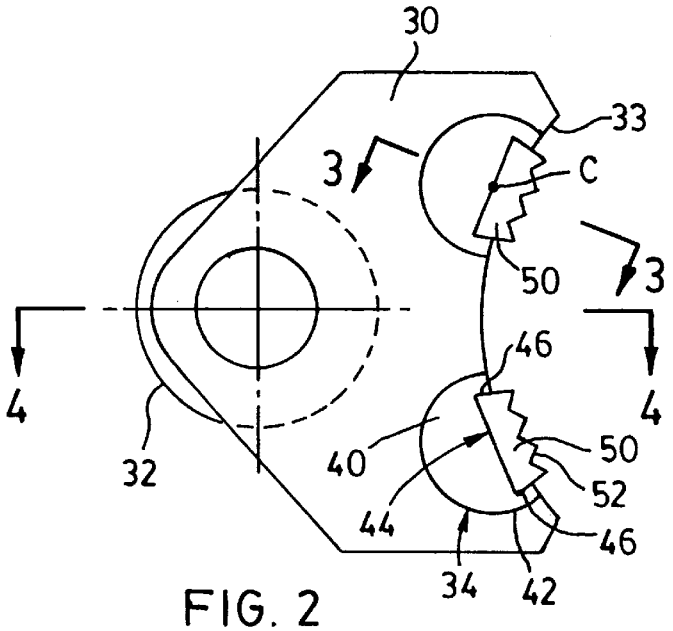
FIG. 2 is a plan view of a jaw assembly according to a first embodiment of the present invention.
Figure 3:
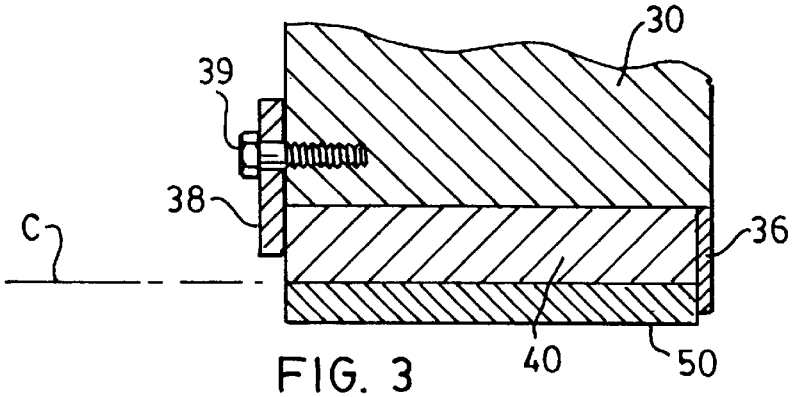
FIG. 3 is a sectional view along line 3—3 of FIG. 2 showing a die, die holder and jaw frame.
Figure 4:
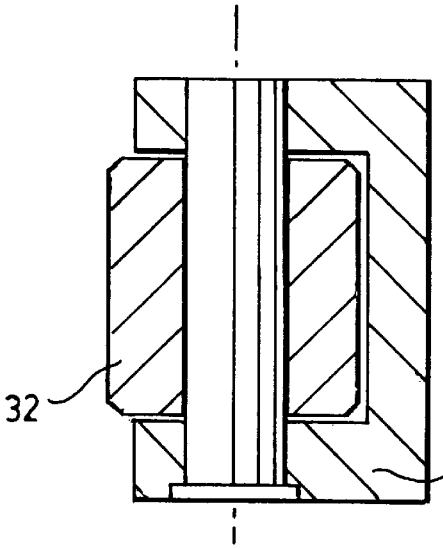
FIG. 4 is a sectional view through the jaw frame along line 4—4 of FIG. 3.

In a first embodiment of the invention shown in FIGS. 2 to 4, a one-piece jaw frame or master jaw 30 has a jaw roller or cam follower 32 for traveling along the rotary gear's cam surface 22 during make up and break out operations. Opposite the roller along a front portion 33 of the jaw frame are two circumferentially spaced die holders 40 housed within correspondingly shaped recesses 34 in the jaw frame. The jaw's front portion is arced to generally follow the curvature of the pipe sections to be gripped, as is known in the art. Each elongate die holder 40 has a cylindrically shaped rear portion 42 for twisting or rotating within the recess about a longitudinal axis C located immediately behind a die insert 50. The arc formed by the recess 34 and the die holder's rear portion 42 is greater than 180 degrees to radially hold the die holder 40 within the recess without further retaining means. The die holder's generally planar front face has an elongate channel 44 for accepting and holding a conventional generally planar or flat die or die insert 50. The die insert's outer pipe engaging surface 52 typically has numerous teeth for gripping the pipe section. The opposed edges 46 of the channel 44 are cambered or toed inwardly to prevent the die insert from popping out of the channel 44 during use.

The die holder 40 can slide in the direction of axis C for removal from the jaw frame, and the die insert 50 may likewise be removed from the die holder. A base plate 36 extends from the bottom end of the jaw frame 30 to support the die holder 40 within the jaw frame and the die insert within the die holder's channel 44. A top plate 38 bolted to the top surface of the jaw frame traps the die holder 40 within the jaw recess 34 without obstructing rotation of the die holder. The top plate 38 may extend over the die 50, although this is not preferred if quick and convenient die replacement is desired.

FIG. 5 shows two alternate embodiments of the invention. For each of the various embodiments disclosed herein, the same reference numbers are used for the same or substantially similar components. In the second embodiment indicated by 60 and shown on the left side of the rotary gear 20, the jaw frame has two parts, namely a base or master jaw portion 62 which holds a jaw insert 64. Referring specifically to FIGS. 6 to 9*c*, the master jaw 62 has a roller 32 at its rear end and a tongue 63 for engaging a complementary shaped cut out 65 at a rear end of the jaw insert 64, both components 62, 64 being fastened in place by a bolt, screw or the like through apertures 66. The jaw insert 64 has a pair of recesses 34 for holding a die holder 70 in each. Although the front face 67 of the jaw insert is generally planar, the recesses 34 are oriented or angled toward each other to facilitate gripping of a pipe section, as discussed earlier. Good results have been achieved using an angle A of about 48 degrees.

In the second embodiment of the jaw assembly each die holder 70 (FIGS. 8*a*–8*c*) has bolt receiving holes 72 at its ends to secure washers 74 (FIGS. 9*a* & 9*b*) for retaining the die 50 within the die holder's channel 44. Each die holder 70 further has a circumferential groove 76 about its circular spine for engaging a dowel pin 69 which extends through a jaw insert hole 68 to support the die holder in the recess 34 and prevent it from slipping out of the jaw insert while allowing the die holder to twist freely about its longitudinal axis C. An access hole 78 is provided so that the dowel pin 69 can be punched when removing the die holder. FIGS. 9*a*–9*c* illustrate the second embodiment of the jaw assembly in its assembled form. Assembly typically first requires a die holder 70 to be placed into each of the recesses 34 of the jaw insert 64. Each die holder 70 is retained therein by inserting a dowel pin 69 through hole 68 until it extends into the die holder's circumferential groove 76. The jaw insert 64 may then be bolted to the master jaw 62 via the apertures 66. A die 50 is then inserted into the die holder's channel 44 and secured therein by the washer arrangement 74.

The third embodiment shown on the right side of FIG. 5 is also a two piece jaw frame, but differs in that an integral or one-piece die insert and die holder 80 are shown. Such variation may be preferred to reduce machining, although more material is wasted when replacing the die 80.

The operation and advantages of the present invention may now be better appreciated. One important feature is that each flat die insert is paired with an individual die holder which is rotatable relative to the pipe segment being made up or broken out, and so the die insert's toothed face tends to squarely engage the pipe section upon initial contact, and then remain substantially tangential to the pipe section during operation. Such alignment or self-centering occurs regardless of the size of conventional pipe section used within the operational range of a particular jaw, be it 4.5 inch OD to 5.5 inch OD for one size of jaw, for instance. Hence, a tong employing the rotatable die holder of the present invention may be used on various pipe sizes without changing the die insert, die holder and jaw. It will be appreciated that for pipe sizes outside such operational range, a new jaw would be required.

Another important feature of the die holder of the present invention is the ability of the die insert and die holder to provide a secondary camming action independent of the primary camming action on the pipe section upon application of torque thereto. As noted earlier, pipe sections tend to slip relative to conventional fixed dies and cause damage to the peripheral surface of the pipe section, which is particularly problematic with drilling pipe where high torques are encountered. In the present invention, any twist or rotation of the pipe section in either direction relative to the die holder causes a proportionate rotation of the die holder about its longitudinal axis C, which causes the point of contact between the die and pipe section to move radially away from the longitudinal axis C, thereby further camming the die holder against the pipe section to retain or increase the grip on the pipe section and reduce or prevent slippage. Regardless of the intensity of the torque being applied by the tong to the pipe section, the same amount of die remains in contact with the surface of the pipe section. Hence, the dies provide an even bite about the pipe section, and a generally uniform radial force is transmitted through each jaw to the pipe section throughout the primary and secondary camming actions.

Although the rotatable die holder of the present invention may be used for any type of pipe section, it is particularly suited for relatively thick walled drill pipe tool joints which are exposed to substantially higher torques than casing and production tubing.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below.

What is claimed is:

1. A jaw assembly for a tong to make up and break out a pipe section comprising:

a jaw element for transferring torque from said tong to said pipe section;

means for moving said jaw element into and out of gripping engagement with said pipe section; and, two die holders rotatably mounted to said jaw element and circumferentially spaced from one another, each of said die holders having a generally cylindrically shaped rear portion rotatably retained within a correspondingly shaped recess in said jaw element, and a front portion having a channel and a die insert receivable in said channel for engaging said pipe section, each of said die holders being adapted to rotate about a first axis oriented generally parallel to a longitudinal axis of said pipe section when said die insert engages said pipe section, said rotation about said first axis allowing each of said die holders to align itself with the pipe section upon engagement of said pipe section with said die insert and providing an independent camming action against said pipe section to at least radially maintain the grip of said die insert on said pipe section during said transfer of torque, said two die holders being oriented toward one another so that the corresponding die inserts may initially engage the pipe section generally tangentially.

2. A jaw assembly for a tong to make up and break out a pipe section comprising:

a jaw element for transferring torque from said tong to said pipe section;

means for moving said jaw element into and out of gripping engagement with said pipe section; and, at least one die holder rotatably mounted to said jaw element and having a generally cylindrically shaped rear portion rotatably retained within a correspondingly shaped recess in said jaw element, and a front portion having a channel and a die insert receivable in said channel for engaging said pipe section, said at least one die holder being adapted to rotate about a first axis oriented generally parallel to a longitudinal axis of said pipe section when said die insert engages said pipe section, said rotation of said at least one die holder about said first axis allowing the at least one die holder to align itself with the pipe section upon engagement of said pipe section with said die insert and providing an independent camming action against said pipe section to at least radially maintain the grip of said die insert on said pipe section during said transfer of torque; and a means for retaining said at least one die holder within said recess in the jaw element comprising a dowel element removably retained in said jaw element and protruding into said recess for engaging a circumferential groove extending about said rear portion of the at least one die holder.

3. A jaw assembly for a tong to make up and break out a pipe section comprising:

a jaw element for transferring torque from said tong to said pipe section;

means for moving said jaw element into and out of gripping engagement with said pipe section; and, at least one die holder carrying a die element, said at least one die holder being rotatably mounted to said jaw element and adapted to rotate about a first axis oriented generally parallel to a longitudinal axis of said pipe section when said die element engages said pipe section, said rotation of said at least one die holder about said first axis allowing the at least one die holder to align itself with the pipe section upon engagement of said pipe section with said die element and providing an independent camming action against said pipe section to at least radially maintain the grip of said die element on said pipe section during said transfer of torque;

wherein a pipe contacting surface of said die element is generally planar for maintaining uniform contact with said pipe section during said camming action and throughout said make up and break out.

4. In a jaw element of a hydraulically operated tong for imparting a first gripping action on a pipe section and transferring a torque thereto during make-up and break out operations, the improvement comprising:

a plurality of die holders carried by said jaw element, each die holder having a single, generally planar pipe engaging die and each die holder being rotatably mounted to said jaw element for rotation about a first axis to align said pipe engaging die generally tangentially with said pipe section upon engagement therewith and to provide a second camming action against said pipe section independent of said first gripping action for maintaining hold of said pipe section and avoiding slippage therebetween during said operations.

5. The jaw element of claim 4 wherein each die holder has a generally cylindrically shaped rear portion rotatably retained within a correspondingly shaped recess in said jaw element for unobstructed rotation about said first axis, and a front portion for carrying said pipe engaging die.

6. The jaw element of claim 5 wherein said first axis is located intermediate said rear and front portions.

7. The jaw element of claim 6 wherein said front portion has a channel therein for removably receiving said pipe engaging die.

8. The jaw element of claim 7 wherein a removable dowel element protrudes into said recess from the jaw element and engages a circumferential groove extending about said rear portion of the die holder for supporting said die holder within said recess.

9. The jaw element of claim 4 wherein said tong includes a cam surface, and said first gripping action is created by a first camming action between said jaw element and said cam surface.

10. A hydraulically operated tong for use in making up and breaking out a threaded connection of axially extending pipe sections comprising:

a tong body for receiving said threaded connection therein;

at least one jaw carried by said tong body;

said tong body having a first gripping arrangement for radially moving said at least one jaw into gripping engagement with said threaded connection to transfer a torque thereto during said making up and breaking out; and, a plurality of die holders carried by said at least one jaw, each die holder having a single, generally planar pipe engaging die and each die holder being rotatably mounted to said at least one jaw for rotation about a first axis to align said pipe engaging die generally tangentially with said treaded connection upon engagement therewith and to provide a second radial gripping action against said threaded connection independent of said first gripping arrangement for maintaining grip on said threaded connection during said making up and breaking out.

11. The tong of claim 10 wherein each die holder has a generally cylindrically shaped rear portion rotatably retained within a correspondingly shaped recess in said jaw for unobstructed rotation about said first axis, and a front portion for carrying said pipe engaging die.

12. The tong of claim 11 wherein said first axis is located intermediate said rear and front portions.

13. The tong of claim 12 wherein said front portion has a channel therein for removably receiving said pipe engaging die.

14. The tong of claim 13 wherein a removable dowel element protrudes into said recess from the jaw and engages a circumferential groove extending about said rear portion of the die holder for supporting said die holder within said recess.

15. The tong of claim 10 wherein said first gripping arrangement includes a first cam surface extending about a portion of said tong body, and wherein at least a portion of said gripping engagement arises through a first camming action created by said at least one jaw traveling along said first cam surface.

* * * * *